United States Patent [19]

Jaques et al.

[11] Patent Number: 4,821,532

[45] Date of Patent: Apr. 18, 1989

[54] BRACELET COMPRISING A FLEXIBLE CORE

[75] Inventors: Bernard Jaques, Bienne; Francis Chatelain, La Chaux-de-Fonds, both of Switzerland

[73] Assignee: Montres Rado, S.A., Lengnau, Switzerland

[21] Appl. No.: 171,583

[22] Filed: Mar. 22, 1988

[30] Foreign Application Priority Data

Mar. 23, 1987 [FR] France ..... 87 04041

[51] Int. Cl.[4] ..... A44C 5/00

[52] U.S. Cl. ..... 63/3; 63/9; 24/265 B; 24/265 WS; 224/178

[58] Field of Search ..... 63/4, 3, 9; 24/68 J, 24/265 B, 265 R, 265 H, 265 WS; 224/178, 179; 59/80, 82

[56] References Cited

U.S. PATENT DOCUMENTS

| | | | |
|---|---|---|---|
| 1,781,379 | 11/1930 | Forstner | 63/3 |
| 1,849,741 | 3/1932 | Doppenschmitt | 63/3 |
| 2,153,659 | 4/1939 | Burk | 63/3 |
| 2,990,679 | 7/1961 | Pascall | 59/80 |
| 3,492,809 | 2/1970 | Gisiger-Lusa . | |
| 3,844,136 | 10/1974 | Rieth et al. | 63/4 |
| 3,889,323 | 6/1975 | Reith | 24/265 B |

FOREIGN PATENT DOCUMENTS

| | | | |
|---|---|---|---|
| 197416 | 10/1986 | European Pat. Off. | 24/265 WS |
| 1118519 | 11/1961 | Fed. Rep. of Germany | 224/179 |
| 566988 | 9/1957 | Italy | 63/3 |
| 630798 | 12/1961 | Italy | 224/179 |

*Primary Examiner*—Kenneth J. Dorner
*Assistant Examiner*—Laurie K. Cranmer
*Attorney, Agent, or Firm*—Griffin, Branigan & Butler

[57] ABSTRACT

A bracelet includes a core of non-extensible flexible material and a plurality of covering elements surrounding the core, each covering element comprising an upper and a lower part assembled to one another. Regular gaps are arranged between the covering elements in which the flexible core is visible. The upper and lower parts are formed of elastic material, in particular steel, and snap fastened to one another. They conform in a manner so as to be assembled or separated without there resulting therefrom any permanent deformation thereof. The bracelet may be fastened to a watch and a clasp and may easily be shortened.

10 Claims, 3 Drawing Sheets

BRACELET COMPRISING A FLEXIBLE CORE

This invention concerns a bracelet including a flexible core made of a material or of a combination of materials which render the core non-extensible in the longitudinal direction and a plurality of covering elements surrounding said core, each comprising an upper part and a lower part assembled to one another.

BACKGROUND OF THE INVENTION

A bracelet corresponding to the general definition which has just been given is described in the Swiss patent document CH-A-566 744. This bracelet includes a longitudinally flexible core of plastic material the lower face of which includes a succession of grooves separated from one another by projections. It also includes a series of covering elements each comprising a lower part and an upper decorative part which may be metallic, for instance stainless steel or gilded metal. The lower part includes a lower wall applied against the surface of one of the projections of the core and two substantially parallel lateral walls applied against the lateral walls of the same projection. The upper part includes an upper wall applied against the surface of the core and two end walls descending along the longitudinal edges of the band each ending with a central foot which is bent into a slot borne by the lower part. The covering elements are thus solidly positioned relative to one another by means of the grooves, thereby avoiding unequal gaps between the covering elements of the assembled bracelet. It can be likewise mentioned that the core of plastic material is hidden from sight by the fact that one of the sides of the upper part includes teeth which project into cavities formed in the contiguous side of the neighbouring upper part.

This construction exhibits several difficulties. It may be mentioned initially that the grooves provided in the core of plastic material comprise numerous weak points and that cracks may begin therein due to fatigue stress which may in time bring about breaking of the bracelet. In order to avoid this, one could increase the existing thickness between the top of the core and the bottom of the groove but this to the detriment of the overall thickness of the bracelet.

It may likewise be mentioned that the described bracelet requires special tooling in order to effect assembly of the covering elements. Thus, the upper part must be bent in order to hook into the lower part. While this assembly may readily be undertaken in the factory on automatic machinery, the question then arises of fixing the length of the bracelet which is generally done by the watch maker repairman on request of the customer. Should the bracelet require shortening, it will necessitate initially removing from the core the end covering element by spreading out the central feet of its upper part which will not be accomplished without trouble and without deforming said part to such an extent that it will be rendered useless and it will thereafter be necessary to fit a new part. Next, it will be necessary to remove from the core at least one complete covering element, to cut the core by the length of one projection and to reassemble it on the lower part of the end covering element by bending over onto it a new upper part. All these operations are delicate and above all risk not being carried out with the desired care in view of the lack of a suitable tooling.

Finally, it will be noted that the teeth with which the upper parts are provided comprise undesirable roughnesses susceptible to hook onto various objects as for instance the wrist portions of shirt sleeves which may consequently be damaged.

SUMMARY OF THE INVENTION

To overcome the difficulties mentioned hereinabove, the present invention is characterized by the fact that the bracelet includes means providing regular gaps between the covering elements and that the upper part and the lower part constituting each of the covering elements are formed of an elastic material and are snap-fastened to one another, said upper and lower parts being conformed in a manner to be assembled or separated without there resulting therefrom any permanent deformation of said elements.

The invention will be understood following reading of the description to follow and in referring to the drawings which illustrate it by way of example.

DESCRIPTION OF THE PREFERRED EMBODIMENT

Figure 1:
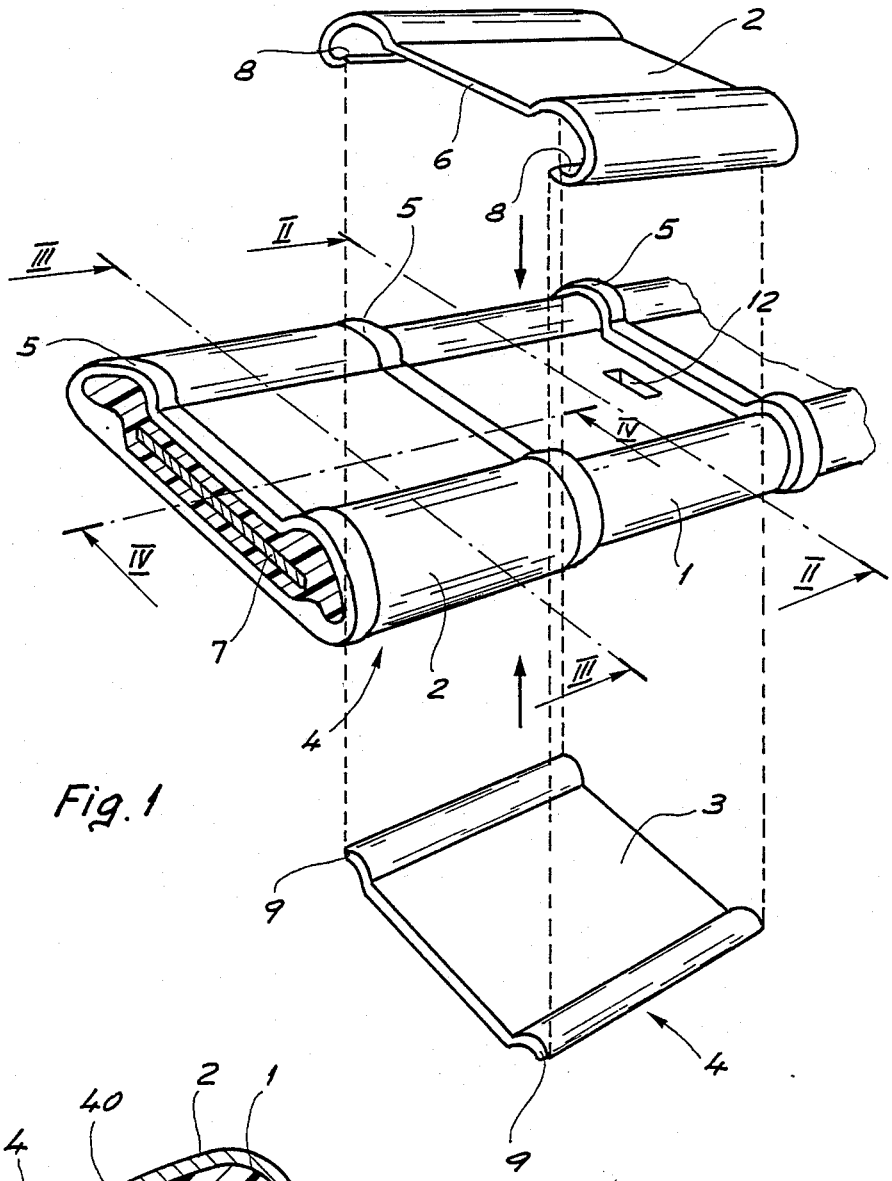
FIG. 1 is a perspective view of the bracelet according to the invention, a portion being shown diassembled with the parts constituting the bracelet and another portion being shown in the assembled state.

The bracelet according to the invention is shown in perspective on FIG. 1. The right hand side of this figure shows the parts constituting the bracelet prior to their assembly. This bracelet comprises essentially a flexible core 1 made of a material which is non-extensible in the longitudinal sense. It could for instance comprise a plastic material such as polyvinyl chloride (PVC). The bracelet further includes a plurality of covering elements 4, each of the latter comprising an upper part 2 and a lower part 3 shown in the separated state on the right hand of the figure. The covering element 4 with its upper part 2 is shown assembled at the left hand side of the same figure. It is understood that once assembled the covering element 4 surrounds the core 1 of the bracelet. Elements 2 and 3 are hooked to one another in a manner which will be described subsequently.

Figure 2:
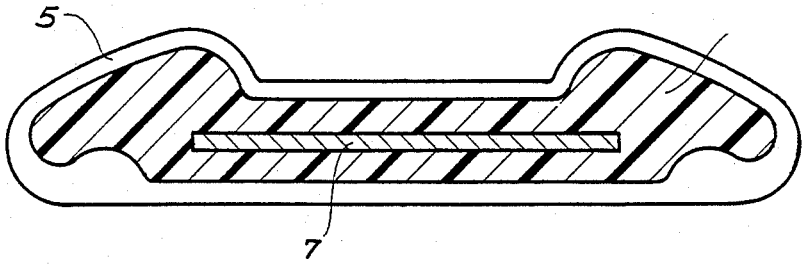
FIG. 2 is a cross-section through the core of the bracelet according to line II—II of FIG. 1.

FIG. 2 is a cross-section along line II—II of FIG. 1 and shows the flexible core 1. In place of the plastic material suggested hereinabove, one could employ rubber or silicone. In this case it is necessary, in order to avoid all stretching of the bracelet in the longitudinal direction, to provide a longitudinal reinforcement 7 which may take the form of a thin leaf of steel buried in the interior of the core and moulded therewith.

Figure 3:
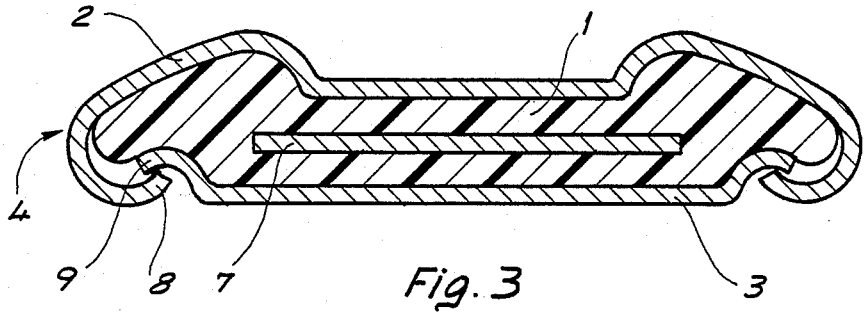
FIG. 3 is a transversal section according to line III—III of FIG. 1.

FIG. 3 is a cross-section along line III—III of FIG. 1. Here one sees core 1 surrounded by a covering element 4 and the upper part 2 and lower part 3 of which this covering element is composed. According to a first basic characteristic of the invention, the elements 2 and 3 are formed of elastic material and are snap-fastened to one another. These snaps are readily visible on FIGS. 1 and 3. They comprise two curled back flanges 8 in the upper part 2 and two U-formed edges 9 raised in the lower part 3. Flanges 8 and edges 9 cooperate in order to form the snap-fastening which is readily visible on FIG. 3. Parts 2 and 3 are preferably formed of metal, this contributing to give the bracelet a high quality aspect. Such metal may be covered if desired with a decorative layer. If a covering is employed it will be understood that the decorative aspect of the bracelet may be varied by giving thereto various colours. One may also provide fantasy by alternating covering elements of different colours.

FIG. 3 shows further that the lower part 3 may be assembled or separated from the upper part 2 without there resulting any permanent deformation of these elements. This is initially due to the hooking of the flanges and edges 8 and 9 which exhibit a very small support surface and thereafter by the fact that these elements are provided of elastic material. To separate one element from the other it will be sufficient to exert a force on one or the other of said elements which will bring about elastic deformation to the point where the flange 8 is no longer facing the edge 9. Following the decoupling, elements 2 and 3 assume their initial forms, this enabling their reutilization if necessary. One manner of detaching these elements from one another will be subsequently described and illustrated by FIG. 7.

Figure 4:
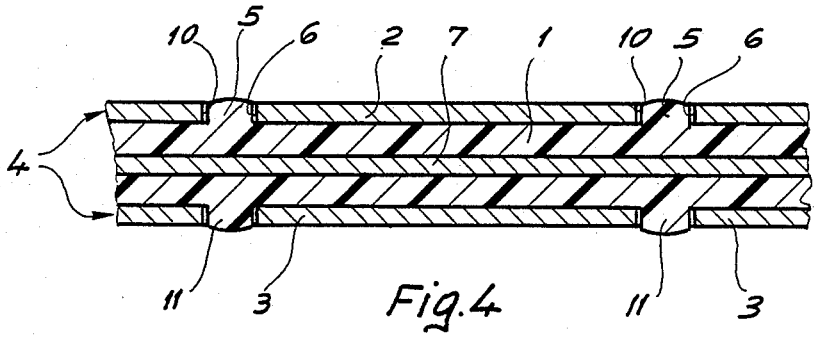
FIG. 4 is a longitudinal cross-section according to line IV—IV of FIG. 1 and according to a first embodiment.

According to a second basic character of the invention, the bracelet further includes means that assure regular gaps between the covering elements 4, these means being shown according to a preferred embodiment in the form of raised beads 5 formed integrally with the core 1 as may be seen on FIG. 1. The gaps thus provided between the covering elements permit the flexible core to appear between said covering elements, this having as purpose to give to the bracelet a special decorative aspect and to render the bracelet continuous in its thickness if the beads as cited hereinabove are employed. This characteristic likewise appears on FIG. 4 which is a cross-section according to line IV—IV of FIG. 1. Each of the beads 5 extends between edges 6 and 10 of two neighbouring covering elements. These beads may be limited to the upper part of core 1, but may also project from the lower part as reference 11 on FIG. 4 shows.

Such as they have been described, beads 5 and 11 likewise pursue another purpose than that which has been set forth which is that of maintaining the covering elements at equal distance from one another and preventing that they slide on the core when the bracelet is handled. Effectively, should one employ a material such as silicone for instance, it will be observed that the bracelet exhibits a softness to the touch which is unrivalled and this precisely because these beads extend between the edges 6 and 10 of the covering elements finally to become flush with the surface of the bracelet and to terminate eventually with a dome as is apparent on FIG. 4. This impression of softness will be particularly sensed thanks to the beads 11 turned towards the wrist. It will be understood however that the beads 5 which are turned upwardly will frequently be in rubbing contact with the clothing and through their aptitude to slide easily, will greatly reduce the wear of clothing (shirt sleeves for instance).

Figure 5:
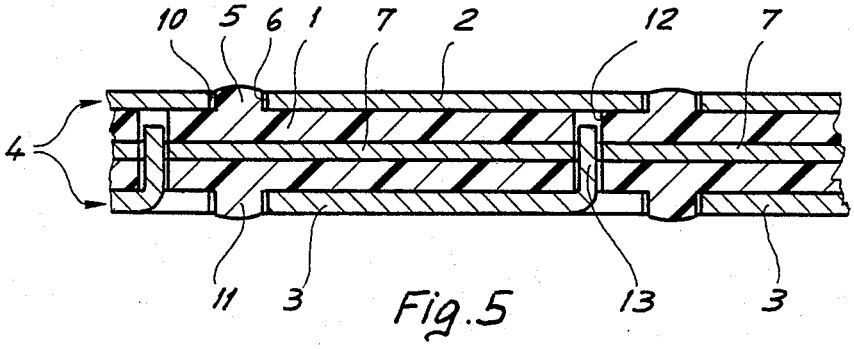
FIG. 5 is a longitudinal cross-section according to line IV—IV of FIG. 1 and according to a second embodiment of the invention.

FIG. 5 which is likewise a cross-section along line IV—IV of FIG. 1 shows a second embodiment of the lower part 3 and of the core 1. Here part 3 includes at least one tongue 13 which is struck perpendicularly to the part in order to penetrate to the interior of an opening 12 provided in core 1. A perspective view of this embodiment is shown on FIG. 6 to which reference will be made. Tongue 13 may be struck from all the lower parts 3, in which case core 1 will be pierced with as many openings 12. These tongues have as purpose to assure a still better positioning of the covering elements relative to one another, positioning which the beads 5 and 11 alone may be insufficient to assure because of the flexible material employed for the core. One may also foresee that in use the edges 6 and 10 of the covering elements 4 may shear the beads 5 and 11. In the case where tongues 13 are employed, this shearing will not be very deep since the displacement of the covering elements on the core will be limited to the play of the tongues 13 in their corresponding openings 12.

Figures 6, 7:
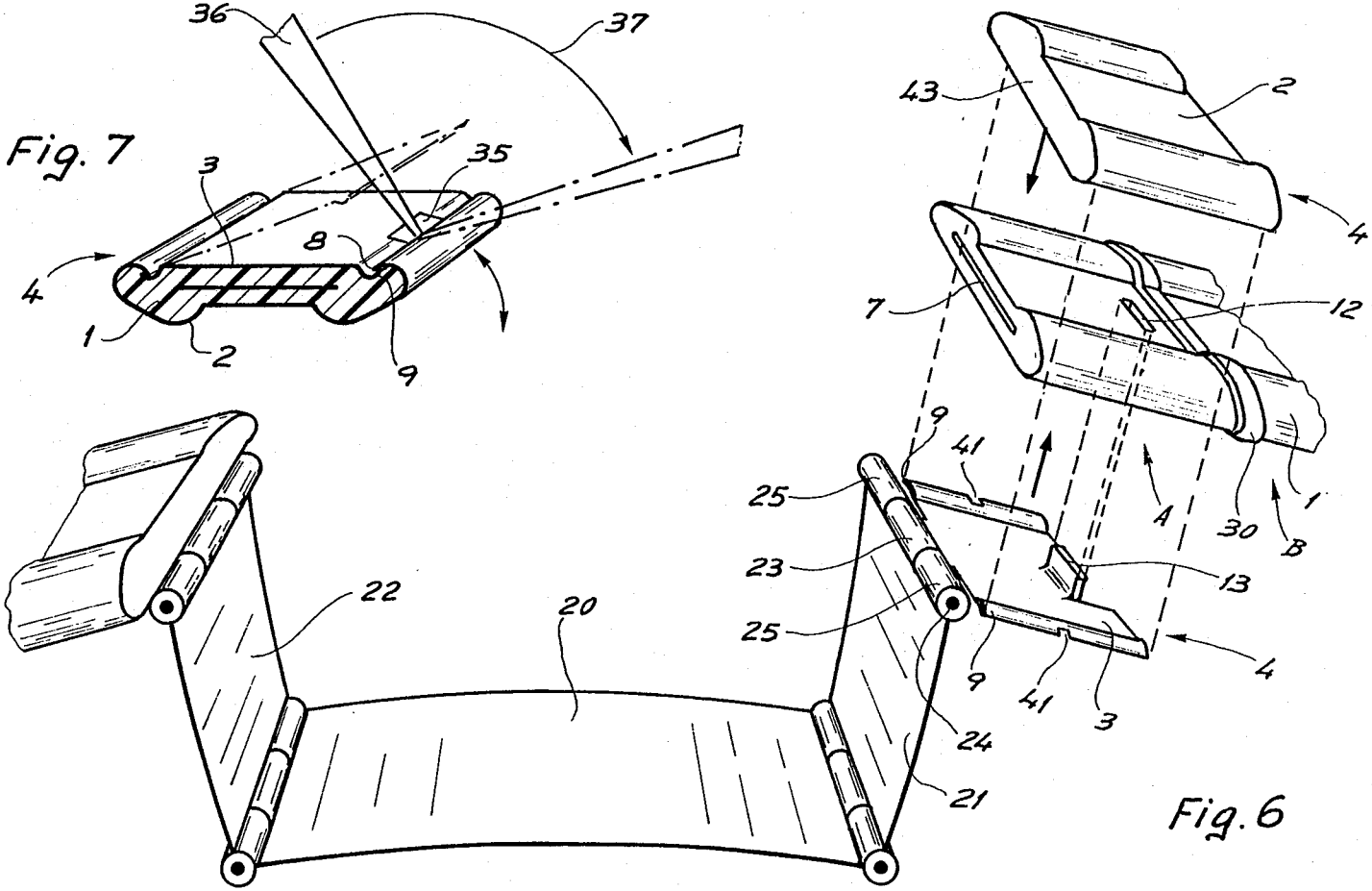
FIG. 6 is a perspective view showing how the bracelet is joined to a clasp.
FIG. 7 is a perspective view showing means for separating the elements constituting the bracelet.

If the bracelet which is the object of the present invention is employed to attach a watch to the wrist, it will be necessary to provide anchoring means for said bracelet to the watch case and to the clasp, this latter generally being provided in the form referred to as the portfolio type. FIG. 6 shows how the bracelet is fixed to the clasp, such fixation being similar to the side of the watch case.

The clasp here is formed of a central portion 20 on which may be folded back two movable parts 21 and 22 to engage with one another. One end of the bracelet is anchored on the part 22. In order better to show the manner in which this anchoring is achieved the part 21 has been shown in perspective, several parts contributing to the anchoring which show a striking analogy with what has been described hereinabove. In like manner thus one finds at the top of FIG. 6 the upper part 2, then below the flexible core 1 provided with its reinforcing 7, finally, third component of the anchoring system and second part of the covering element 4, the lower part 3 provided with its snap edges 9 and its tongue 13. In this figure the lower part 3 is distinguished from the other elements 3 of the bracelet by the presence of a hinge 23 and two openings 41. Through this hinge there is introduced pin 24 driven into two guide members 25 located at the end of the movable portion of the clasp. Thus the lower part 3 is jointedly mounted on the movable part of the clasp and receives the core 1 and the upper part 3 as has already been explained.

The openings 41 provided in the snap edges 9 of the lower part 3 have as a function to position and to fix the lower part 2 onto the last section A of core 1. FIG. 6 shows effectively that the last upper part 2 is not opened on the hinge side but closed by means of a wall 43. Here one is concerned with a specially formed part (a similar element is found on part 22 of the clasp) in order to hide the end of core 1. As this end does not bear a bead, part 2 is not well retained axially and may escape from the core by slipping toward the left of the figure. This positioning function will now be explained with reference to FIG. 8.

Figure 8:
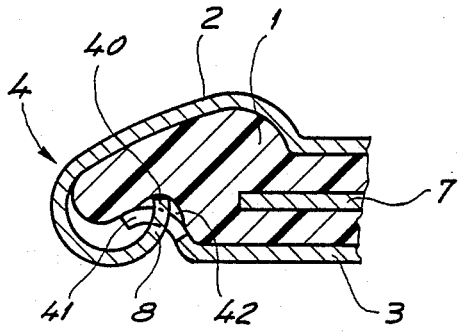
FIG. 8 is a partial transversal cross-section according to line III—III of FIG. 1 and showing a variant of the embodiment illustrated by FIG. 3.

FIG. 8 is a partial transversal cross-section along line III—III of FIG. 1 and shows a variant of the embodiment illustrated by FIG. 3. This FIG. 8 is also a partial cross-section provided along the center of the end covering element of FIG. 6, in supposing this covering element to be assembled on core 1. On each of the longitudinal flanges 8 of the upper part 2, there is raised a claw 40 which goes through the opening 41 provided in the lower part 3, to end up by burying itself in core 1 at the place referenced 42. Part 2 is thus immobilized on the core 1. The variant which has just been described is not limited to the end covering elements, but could also be employed at least for the covering elements for which separation is not envisaged. It could advantageously replace the tongue 13 and the corresponding opening 12 described with reference to FIG. 5.

FIG. 6 enables explaining how one may proceed to shorten the bracelet by a section or by a covering element if this operation must be undertaken. One begins by freeing core 1 and the end element 2 as shown on FIG. 6. Section A of core 1 is then free of a covering element which enables cutting off thereof (by means of a knife or scissors) flush with the bead referenced 30, this bead falling away with section A. One removes the section B of the covering element 4 (not shown here). Then the lower part of section B is placed on the lower part 3 forming the hinge by introducing the opening 12 of section B into the tongue 13 of the same hinge element 3. One snaps the end part 2 on section B of the core and the shortening operation is terminated. It will be noted that the tongue 13 and the opening 12 in which it penetrates are here employed to solidly fasten the bracelet to the clasp. Thus, to facilitate manufacture in series, the flexible core will be advantageously provided with as many openings as there are places provided to receive a covering element, even if the ordinary lower parts 3 are not provided with a tongue 13 (as is illustrated on FIG. 1).

To facilitate the separation of the covering elements one may employ the means shown on FIG. 7. Here the lower part is provided with an opening 35 located proximate the flange 8 of the upper part 2. There is introduced to the interior of this opening the point of a tool 36 which is caused thereafter to pivot in the sense of arrow 37. In this manner the tool being supported at the same time against the flange 8 and against a wall of the opening 35 spreads the flange 8 from the edge 9 and enables disengagement of said elements as may be seen in dotted lines on FIG. 7. In order to proceed to the assembly operation one introduces part 3 as shown on dotted lines on the figure, then one forces by means of a tool the edge 9 of part 3 to pass under the flange 8 of part 2 which will be accomplished without difficulty in view of the elasticity exhibited by said parts.

In addition to the decorative qualities and the wearing comfort the bracelet which forms the object of this invention is easy to assemble if one has available the flexible core and the two types of parts comprising the covering elements. The core may be cut to a desired length and decoration accomplished to the taste of the buyer should one have available a certain choice of these parts.

What we claim is:

1. A bracelet including a flexible core (1) formed of a material which renders such core non-extensible in the longitudinal direction and a plurality of covering elements (4) surrounding said core each comprising an upper part (2) and a lower part (3) assembled to one another, raised beads (5) integrally formed with the core and extending between edges (6, 10) of two adjacent covering elements, said beads providing regular gaps between said covering elements the upper part and the lower part forming each covering element being formed of elastic material and snap fastened to one another, said upper and lower parts conforming in a manner to be assembled or separated without there resulting therefrom a permanent deformation of said parts.

2. A bracelet as set forth in claim 1 wherein the core is of rubber provided with a longitudinal reinforcement.

3. A bracelet as set forth in claim 2 wherein the longitudinal reinforcement (7) comprises a thin leaf of steel enclosed within the core.

4. A bracelet as set forth in claim 1 wherein the core is of a silicone provided with a longitudinal reinforcement.

5. A bracelet as set forth in claim 3 wherein the longitudinal reinforcement (7) comprises a thin leaf of steel enclosed within the core.

6. A bracelet as set forth in claim 1 wherein the lower (3) and upper (2) parts forming each covering element (4) are of metal.

7. A bracelet as set forth in claim 1 wherein each of the lower parts is provided with an opening adapted to accommodate a tool to separate said lower parts from the corresponding upper part by elastic deformation of said parts.

8. A bracelet as set forth in claim 1 wherein each of the upper parts (2) further comprises a claw (40) on at least one of the longitudinal edges (8) of said upper part, said claw being partially sunk into the core and passing through a corresponding opening (41) formed in the lower part.

9. A bracelet as set forth in claim 1 wherein the means providing regular gaps between the covering elements further include a claw on at least one of the longitudinal edges of each upper part partially sunk into the core, said claw passing through a corresponding opening formed in the lower part.

10. A bracelet as set forth in claim 1 further including means for anchoring the core to a watch case and a clasp each of which includes a covering element similar to those arranged along the core, the lower part of such covering element being provided with a hinge jointed respectively to said watch case and to said clasp and a tongue rising perpendicularly therefrom said tongue penetrating to the interior of an opening formed in said core.

* * * * *